US006117215A

United States Patent [19]

Erickson et al.

[11] Patent Number: 6,117,215

[45] Date of Patent: Sep. 12, 2000

[54] ELECTRO-MAGNETIC RAPPER WEAR GUIDE

[75] Inventors: Richard Michael Erickson, Charleston; Isaac Espinosa Ortiz, Isle of Palms, both of S.C.

[73] Assignee: Westvaco Corporation, New York, N.Y.

[21] Appl. No.: 09/285,989

[22] Filed: Apr. 5, 1999

[51] Int. Cl.[7] ..... B03C 3/76

[52] U.S. Cl. ..... 96/36; 96/37; 335/260

[58] Field of Search ..... 96/34, 36, 37, 96/38; 95/76; 173/122, 206, 210; 335/260

[56] References Cited

U.S. PATENT DOCUMENTS

| | | | |
|---|---|---|---|
| 2,922,085 | 1/1960 | Drenning et al. | 96/36 |
| 2,985,802 | 5/1961 | Drenning | 96/36 |
| 3,477,124 | 11/1969 | Archer et al. | 335/260 X |
| 3,504,480 | 4/1970 | Copcutt et al. | 96/36 X |
| 3,570,628 | 3/1971 | Rodgers | 96/37 X |
| 4,120,672 | 10/1978 | Lanese | 96/36 |
| 4,255,775 | 3/1981 | Andrews | 96/36 X |
| 4,305,736 | 12/1981 | Kahl et al. | 96/36 |
| 4,693,732 | 9/1987 | Blackford et al. | 96/37 |
| 4,838,363 | 6/1989 | Mac Onochie | 173/210 |
| 4,928,456 | 5/1990 | Del Gatto et al. | 95/74 |
| 5,584,915 | 12/1996 | Broughton | 95/76 X |

*Primary Examiner*—Richard L. Chiesa
*Attorney, Agent, or Firm*—J. R. McDaniel; R. L. Schmalz

[57] ABSTRACT

This invention relates to electro-magnetic rappers which are used on precipitators. Such structures of this type, generally, employ the use of a wear guide which reduces rapper liner wear.

4 Claims, 1 Drawing Sheet

ELECTRO-MAGNETIC RAPPER WEAR GUIDE

BACKGROUND OF THE INVENTION

1. Field of the Invention

This invention relates to electro-magnetic rappers which are used on precipitators. Such structures of this type, generally, employ the use of a wear guide which reduces rapper liner wear.

2. Description of the Related Art

Precipitators are used for the collection of particulate matter generated during combustion. It is very important for the precipitator to perform at its highest level because it is the last line of defense for preventing environmental emissions into the atmosphere. Every component in the precipitator must be operating at 100% to ensure proper collection of particulate matter.

The function of the electro-magnetic rapper is to generate a shock wave that will dislodge collected matter in such a manner that it is gently dropped to the bottom of the precipitator where it will be removed. If the rappers are not working at a consistently high level, emissions to the atmosphere will be greater than desired.

It has been observed that rappers operate at various levels of efficiency due to the severity of rapper liner wear. In fact, it has been observed that severely worn liners will not allow the piston to move at all. This is because as the rapper liner wears due to friction, the magnetic attraction between the piston and the flange at the base of the housing becomes greater. When the magnetic attraction increases, the wear of the liner is accelerated. The two forces compliment each other and this continues until there is a piston-to-flange contact. When this happens, the rapper is at the end of its service life and needs to be replaced.

It is known, in electro-magnetic rappers to employ various internal wear guides. Exemplary of such prior art are U.S. Pat. No. 2,985,802 ('802) to J. W. Drenning, entitled "Magnetic Impulse Rapper" and U.S. Pat. No. 3,477,124 ('124) to W. E. Archer et al., entitled "Method of Making an Electrical Rapper". While the '802 and '124 patents employ the use of internal wear guides, the reciprocating action of the piston within the rapper still can erode the wear guides and, therby adversely affect the performance of the rapper. Consequently, a more advantageous rapper, then would be presented if the performance of the rapper could be improved.

It is apparent from the above that there exists a need in the art for an electro-magnetic rapper which at least equals the performance characteristics of the known rappers, but which at the same time eliminates the magnetic attraction between the piston and the flange. It is the purpose of this invention to fulfill this and other needs in the art in a manner more apparent to the skilled artisan once given the following disclosure.

SUMMARY OF THE INVENTION

Generally speaking, this invention fulfills these needs by providing an improved electro-magnetic rapper, comprising: an electro-magnetic rapper having a rapper casing having first and second ends; a piston located substantially within the casing; a cylindrical liner substantially surrounding the piston and located a predetermined distance away from the piston; a coil means located substantially along the first end of the rapper casing; a flange means having first and second sides located substantially at the second end of the rapper casing such that the first side of the flange means substantially abuts the second end of the rapper casing; and a flange support means rigidly attached to the flange means for supporting the rapper, wherein the improvement is comprised of a polymeric wear guide means located adjacent to the second side of the flange means and rigidly attached to the flange support means.

In certain preferred embodiments, the polymeric wear guide means is a cylindrical, one-piece plate constructed of a high density polymer.

In another further preferred embodiment, substantially all of the liner wear, due to friction, is eliminated through the use of the polymeric wear guide located on the outside of the rapper.

The preferred rapper, according to this invention, offers the following advantages: ease of assembly and repair; good stability; excellent durability; good economy; and reduced liner wear. In fact, in many of the preferred embodiments, these factors of ease of assembly, durability and reduced liner wear are optimized to an extent that is considerably higher than heretofore achieved in prior, known rappers.

BRIEF DESCRIPTION OF THE DRAWING

The above and other features of the present invention, which will become more apparent as the description proceeds, are best understood by considering the following detailed description in conjunction with the accompanying drawing, in which the single

DETAILED DESCRIPTION OF THE INVENTION

Figure 1:
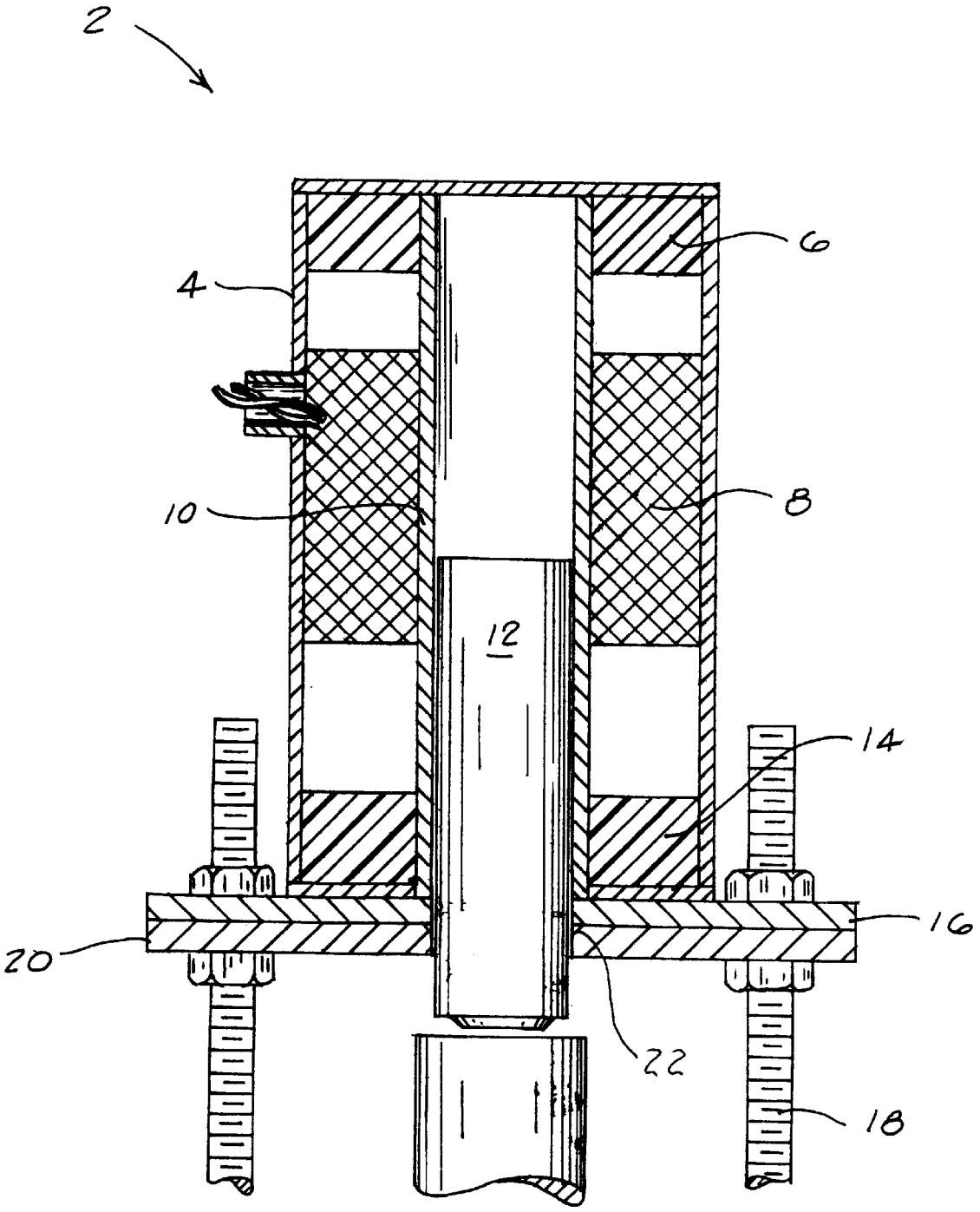
FIG. 1 is a side, plan view of an electro-magnetic rapper with a wear guide, according to the present invention.

With reference first to the FIG. 1, there is illustrated an advantageous environment for use of the concepts of this invention. In particular, electro-magnetic rapper 2 is illustrated. Rapper 2 includes, in part, conventional casing 4, conventional epoxy 6, conventional coil 8, conventional liner 10, conventional piston 12, conventional epoxy 14, conventional flange 16, conventional mounting bolts 18, and wear guide 20.

Wear guide 20, preferably, is a cylindrical plate constructed of any suitable, durable, high density polymeric material such as HYPACT, SR-12 polymer, produced by the King Plastic Corporation of Venice, Fla.

As discussed earlier, liner 10 has experienced significant wear in prior, known rappers. The solution of the present invention is to extend the life of rapper 2 by installing wear guide 20 underneath flange 16 at the base of rapper casing 4. The diameter of the center hole in wear guide 20 is cut to a smaller dimension than the inside diameter of the original liner 10. Maintaining a gap between piston 12 and liner 10 reduces the magnetic attraction between piston 12 and flange 16. This allows rapper 2 to work better than when new.

The properties of wear guide 20 are better suited to withstand friction and this prevents the onset of reduced efficiency which caused the original rapper liners to wear out. Also, the improved efficiency and reliability of rapper 2 will help reduce environmental emissions by providing a more uniform cleaning action inside the precipitators.

Once given the above disclosure, many other features, modifications or improvements will become apparent to the skilled artisan. Such features, modifications or improvements are therefore, considered to be a part of this invention, the scope of which is to be determined by the following claims.

What is claimed is:

1. An improved electro-magnetic rapper, wherein said rapper is comprised of:

an electro-magnetic rapper having a rapper casing having first and second ends;

a piston located substantially within said casing;

a cylindrical liner substantially surrounding said piston and located a predetermined distance away from said piston;

a coil means located substantially along said first end of said rapper casing;

a flange means having first and second sides located substantially at said second end of said rapper casing such that said first side of said flange means substantially abuts said second end of said rapper casing; and a flange support means rigidly attached to said flange means for supporting said rapper, wherein said improvement is comprised of, a polymeric wear guide means located adjacent to said second side of said flange means and rigidly attached to said flange support means.

2. The rapper, as in claim 1, wherein said wear guide means is further comprised of:

a high density polymer.

3. The rapper, as in claim 1, wherein said wear guide means is further comprised of:

a cylindrical plate having a circular hole which has a smaller diameter than a diameter of said liner.

4. The rapper, as in claim 1, wherein said flange support means is further comprised of:

mounting bolts.

* * * * *